United States Patent [19]

Wootton

[11] Patent Number: 4,939,418

[45] Date of Patent: Jul. 3, 1990

[54] GAS MIXTURE FOR TRIGGERABLE SPARK GAPS

[75] Inventor: Roy E. Wootton, Murrysville, Pa.

[73] Assignee: The United States of America as represented by the Secretary of the Air Force., Washington, D.C.

[21] Appl. No.: 838,976

[22] Filed: Mar. 12, 1986

[51] Int. Cl.[5] ..... H01J 17/46

[52] U.S. Cl. ..... 313/595; 313/603; 313/643

[58] Field of Search ..... 313/643, 603, 595, 602, 313/897

[56] References Cited

U.S. PATENT DOCUMENTS

| | | | |
|---|---|---|---|
| H60 | 5/1986 | Elkins et al. | 313/643 X |
| 3,183,392 | 5/1965 | Craker et al. | 313/188 |
| 3,387,216 | 6/1968 | Gagliardi et al. | 328/8 |
| 3,449,615 | 6/1969 | Tucker et al. | 313/226 |
| 3,786,275 | 1/1974 | Quesinberry et al. | 307/136 |
| 4,246,509 | 1/1981 | Schäfer et al. | 313/643 |
| 4,419,605 | 12/1983 | Branston | 313/485 |

*Primary Examiner*—Kenneth Wieder

*Attorney, Agent, or Firm*—William G. Auton; Donald J. Singer

[57] ABSTRACT

A particular gas mixture (90% $N_2$+10% Xe) in a triggerable spark gap discharger is disclosed which allows the spark gap to be triggered with a low main-gap voltage over a much wider range of trigger voltages (e.g., 16–30 or more kV), than with nitrogen (e.g., 19–22 kV) or other commonly used gases and mixtures. The improvement is important where triggerable spark gaps are used in protective circuits.

2 Claims, 3 Drawing Sheets

GAS MIXTURE FOR TRIGGERABLE SPARK GAPS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to triggerable spark gap dischargers as protective devices, and specifically to a particular gas mixture which improves the performance of such devices.

Triggerable spark gap dischargers are used as protective devices which have a variety of applications. Exemplary in the art are the systems disclosed in the following U.S. Patents, the disclosure of which are incorporated by reference:

U.S. Pat. No. 3,183,392 issued to Craker;
U.S. Pat. No. 3,387,216 issued to Gagliardi;
U.S. Pat. No. 3,449,156 issued to Tucker;
U.S. Pat. No. 3,786,275 issued to Quesinberry; and
U.S. Pat. No. 4,419,605 issued to Branston.

Mr. Roy E. Wootton describes the protection of klystrons in radar sets in his patent application entitled "Triggered Spark Gap Discharger" Application Ser. No. 06,617,449, filed on 5 June 1984, the disclosure of which is incorporated by reference. Such triggering circuits protect klystrons from damage when a breakdown occurs in the vacuum inside the klystron.

When a breakdown occurs in the klystron, the collapsing voltage appears at the trigger pin of the gas-filled spark gap and causes breakdown of the main gap. This shorts the dc power supply to ground and prevents the energy on the capacitor (several hundred Joules) from damaging the klystron. Because the voltage on the main-gap of the spark gap is falling at the time the trigger gap fires, it is important that the spark gap works effectively at the lower end of its operating range. This range should be as wide as possible, and the gap should be able to respond to as wide a range of trigger voltage amplitudes as possible.

An example of the current operating range produced by protective circuits using spark gaps, is the range of 19–22 kv when pure nitrogen $N_2$ is selected as the gas to fill the gaps. Such triggering behavior is typical of commercial triggerable spark gap circuits. However, note that higher or lower voltages outside the operating range will not fire the main gap, even though the trigger gap may briefly fire with the higher trigger voltages.

This type of undesirable behavior occurs for gaps filled with a variety of gases and mixtures. It also is known to occur with both new and aged spark gaps, and variations of trigger electrode and insulator geometry.

From the foregoing discussion, it is apparent that there currently exists the need to expand the operating range of triggerable spark gap protective circuits. The present invention is intended to satisfy that need.

SUMMARY OF THE INVENTION

The present invention is a particular gas mixture (90% $N_2$+10% Xe) in a triggerable spark gap which allows the spark gap to be triggered with a low main-gap voltage, and a much wider range of trigger voltages (e.g., 16–30 kV), than with nitrogen or other commonly used gases and mixtures The improvement of the present invention is important where triggerable spark gaps are used for protective circuits. One such circuit is a triggerable spark gap circuit for protection of a klystron tube from damage resulting from internal breakdown. The circuit comprises a voltage source in parallel with a charging capacitor, a gas filled triggerable spark gap, a series capacitor, resistance and inductance, and a klystron tube. The gas mixture of the present invention allows the spark gap to break down at a lower voltage. This breakdown removes the voltage from the klystron tube so that it avoids irrepairable damage when it sparks over.

It is an object of the present invention to provide a wider range of trigger voltages to triggerable spark gap protection circuits.

It is another object of the present invention to provide an improved gas mixture which enables existing triggerable spark gaps to be triggered with a lower main-gap voltage, than that resulting from presently-used gases and mixtures.

It is another object of the present invention to improve the protection given to klystron tubes in radar systems.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a particular gas mixture (90% $N_2$+10% Xe) which is intended for use in a triggerable spark gap, and which allows the spark gap to be triggered with a low main-gap voltage over a much wider range of trigger voltages (e.g., 16–30 or more kV), than with nitrogen (e.g., 19–22 kV) or other commonly used gases and mixtures.

Figure 1:
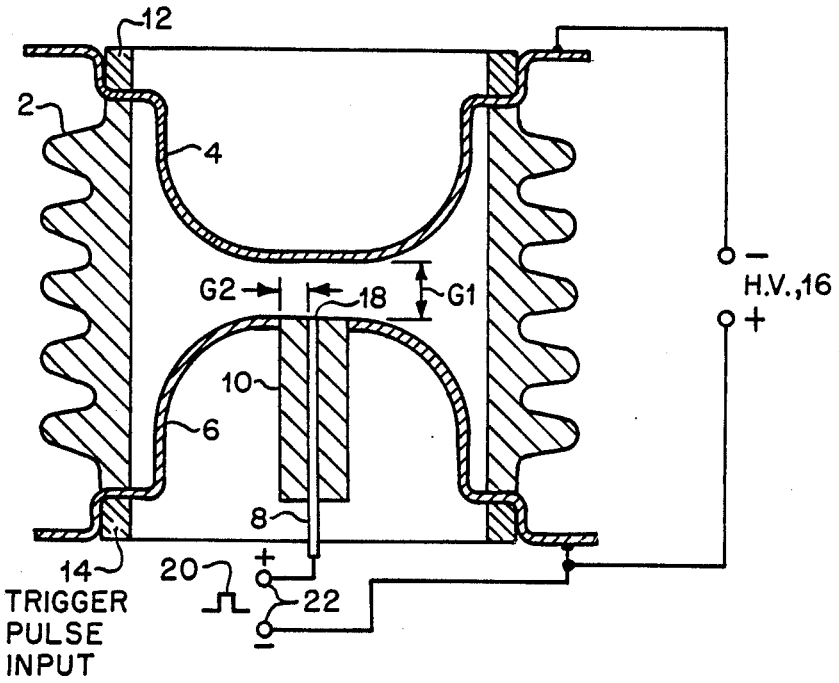
FIG. 1 PRIOR ART
FIG. 1 is an axial cross-section of a conventional triggerable spark gap discharger.

The reader's attention is now directed towards FIG. 1, which is an axial cross-section of a conventional triggerable spark gap discharge, which is used in protection circuits in radar systems to protect klystron tubes. The spark gap discharger of FIG. 1 is commercially available, and consists of a cylindrical porcelain insulator 2 having a pair of primary electrodes 4 and 6 enclosing the ends thereof. Electrode 6 has an axially aligned trigger probe or pin 8 therethrough, which is insulated from electrode 6 by a porcelain tube 10. Insulative rings 12 and 14 are located at the open surfaces of the substantially hemispherical electrodes 4 and 6. The spark gap discharger is filled with an ionizable gas which, for example, may be pure nitrogen, or a mixture of gases such as nitrogen and a small amount of oxygen.

The gap G1 between electrodes 4 and 6 is the primary gap for discharge of high voltage applied across electrodes 4 and 6 via terminals 16. A trigger spark gap G2 is formed between the tip 18 of trigger probe 8 and primary electrode 6. A trigger pulse 20 is applied between trigger probe 8 and main electrode 6 via terminals 22. As mentioned earlier, the trigger gap G2 breaks down under the influence of trigger pulse 20 to provide a source of electrons to initiate the breakdown of the primary gap G1.

In the conventional triggered spark gap discharger, depicted in FIG. 1, the pair of electrodes 4 and 6 are spaced far enough apart such that the voltage applied across the electrodes is insufficient to electrically breakdown the gap therebetween. The gap remains a very good insulator at voltages below its hold-off value. When it is desired to initiate the flow of current, a method must be provided to cause sufficient ionization of the gas between the electrodes to allow the gap to breakdown. This may be accomplished by a sudden increase of the voltage across the gap, a sudden reduction in the gap spacing, a sudden reduction in gas density, natural radioactive irradiation of the gap, ultraviolet irradiation of the gap, a heated filament in the gas dielectric, distortion of the electric field of the gap, or injection of ions and/or electrons into the gap.

Commercially available triggered spark gap dischargers sometimes use a pair of hemispherical primary electrodes with an axial trigger probe in one electrode. Upon application of a trigger pulse, an auxiliary spark is generated inside the gap between the trigger probe and its associated primary hemispherical electrode, or the other primary electrode, depending upon the gap design and the polarity of the electrodes. The auxiliary spark provides a source of electrons and ions and forms a low-density region due to the energy dissipated by the trigger spark. The combination is mounted in a sealed chamber filled with an ionizable gaseous medium.

One application for triggerable spark gap dischargers, such as the one shown in FIG. 1, is in the protection of klystrons from damage due to internal short circuits by preventing occasional breakdown currents therein from reaching values of more than a few hundred amperes. Since this current may reach a few hundred amperes in about 20 nanoseconds, the triggered spark gap must fire reliably and very promptly if it is to protect the klystron adequately. Failure of the trigger spark gap to fire can lead to damaging currents of several thousand amperes through the klystron.

Figure 2:
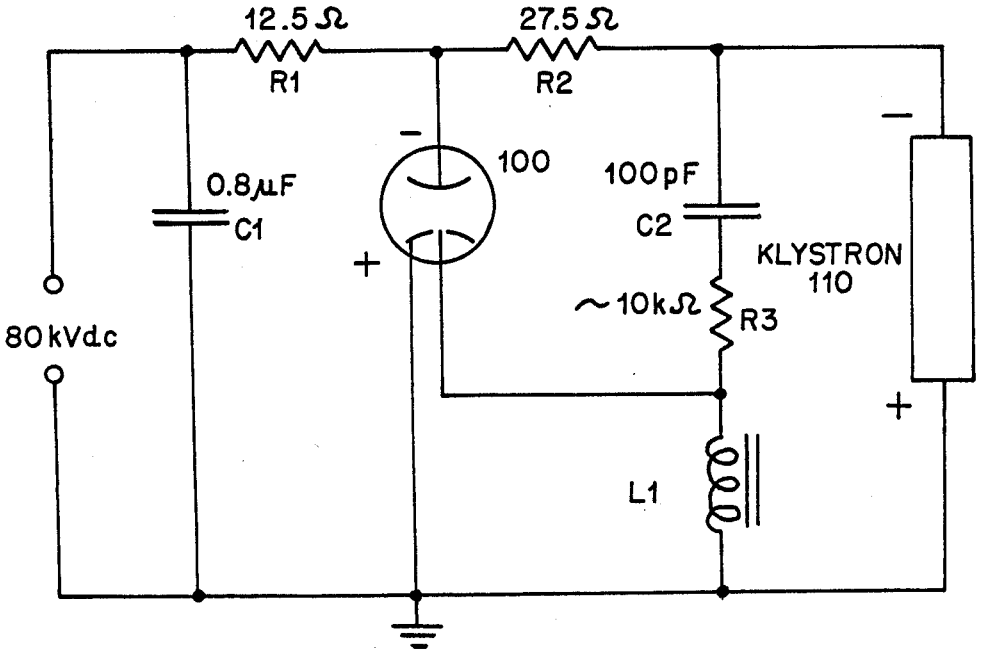
FIG. 2 PRIOR ART
FIG. 2 is an electrical schematic of a protection circuit using the spark gap discharger of FIG. 1.

FIG. 2 is an electrical schematic of a protection circuit which uses a triggerable spark gap discharger 100 to protect a klystron tube 110 from damage resulting from internal breakdown. When a breakdown occurs in the klystron 110 the collapsing voltage appears at the trigger pin of the gas-filled spark gap 100 and causes breakdown of the main gap. This shorts the dc power supply to ground and prevents the energy on the capacitor $C_1$ (several hundred Joules) from damaging the klystron 110. Since the voltage on the main-gap of the spark gap 120 is falling at the time the trigger gap fires, it is important that the spark gap 120 works effectively at the lower end of its operating range. This range should be as wide as possible, and the gap should be able to respond to as wide a range of trigger voltage amplitudes as possible. The triggerable spark gap discharger 100 used in FIG. 2 is commonly filled with pure nitrogen. It has been found by experiment that in such instances, when pure nitrogen is used, at low main-gap voltage (e.g., 25 kV dc), the main-gap can be fired by trigger voltages in a restricted range of voltages only (e.g., 19–22 kV). Higher or lower voltages outside this restricted range do not fire the main gap (even though the trigger gap fires with high trigger voltages). This type of undesirable behavior occurs for gaps filled with many gases including: $N_2+1\%$ $O_2$, $N_2+10\%$ He and, $N_2+10\%$ He$+1\%$ $O_2$. This undesirable behavior persists in both new and aged triggerable spark gap dischargers, and with variations of trigger electrode and insulator geometry. However, it does not occur with one particular gas mixture.

The above undesirable failure of the main gap to trigger with a combination of low main-gap voltage and high trigger voltage amplitude, is absent if the gap is filled with a gas mixture containing $N_2+10\%$ Xe. This "magic mixture" shows almost no variation in triggering behavior with trigger amplitude and in particular there is no increase in the reluctance to fire as the trigger voltage amplitude is increased.

Figure 3:
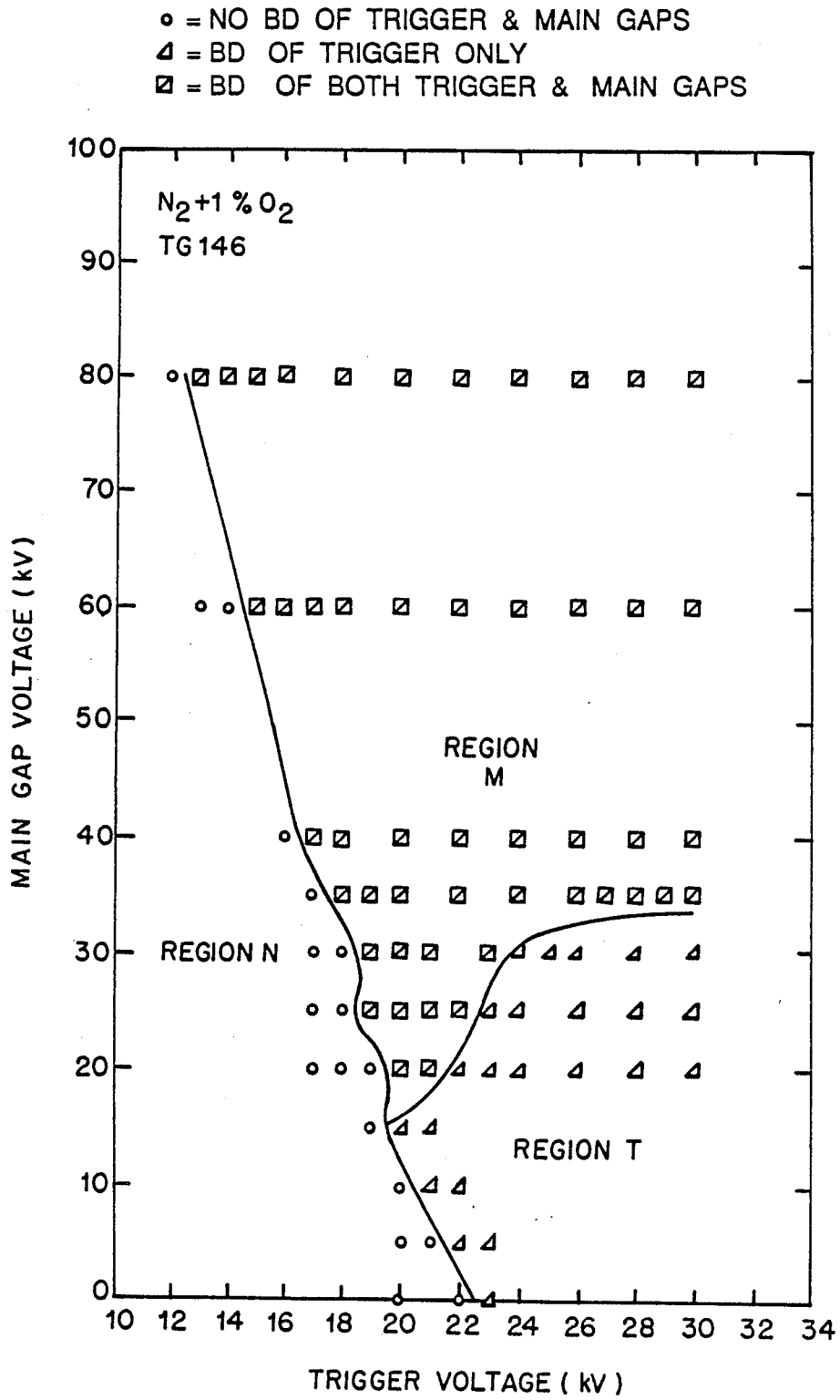
FIG. 3 is a chart depicting the triggering map of a conventional spark gap discharger using nitrogen plus one percent oxygen.

FIG. 3 is a chart depicting the triggering map of a conventional triggerable spark gap discharger, when the gas used is nitrogen plus 1% oxygen. This map covers low main gap voltages and low to medium trigger voltages since the highest fault currents occur in this region. In this map, there are three regions: there is one region in which neither the trigger nor the main gap fires (marked "Region N"), a second region in which the trigger gap fires but the main gap does not (marked "Region T"), and a third region in which both gaps fire (marked "Region M"). However, the "satisfactory performance" region occupies only part of the last region because the delay to breakdown can be long even when both gaps fire. No attempt has been made to determine or indicate the "satisfactory" regions in FIG. 3. Each point on the map represents one or more attempts to trigger the gap. The horizontal position of the point represents the trigger voltage (rise time about 20 ns), while the vertical position represents the main gap voltage. The response of the gap to these two voltages is represented by an "o" (meaning neither the trigger gap nor the main gap fired), a "Δ" (trigger gap fired), or by an "⧄" (both gaps fired). Thus, the plot represents a map of gap response to attempts to trigger it around the lower limit of its operating envelope.

FIG. 3 shows the characteristic of the probability of triggering decreasing with increasing trigger voltage for certain ranges of (low) main gap voltage. The map shows that the magnitude and reproducibility of this effect, and the large region in which this phenomenon occurs. It also shows that the larger the trigger voltage the higher the main-gap voltage can be without breakdown of the main gap. That is, the larger the trigger voltage, the poorer the triggering behavior at the lower limit of its main gap operating envelope.

FIG. 3 indicates that for a range of main gap voltages (20 kV to about 35 kV), trigger voltages in the range 19 kV to 21 kV usually cause both the trigger and main gaps to breakdown. However, for the same range of main gap voltages, larger trigger voltages cause the trigger gap to breakdown without breakdown of the main gap. The effect occurs in both gas mixtures and in nitrogen alone.

Figure 4:
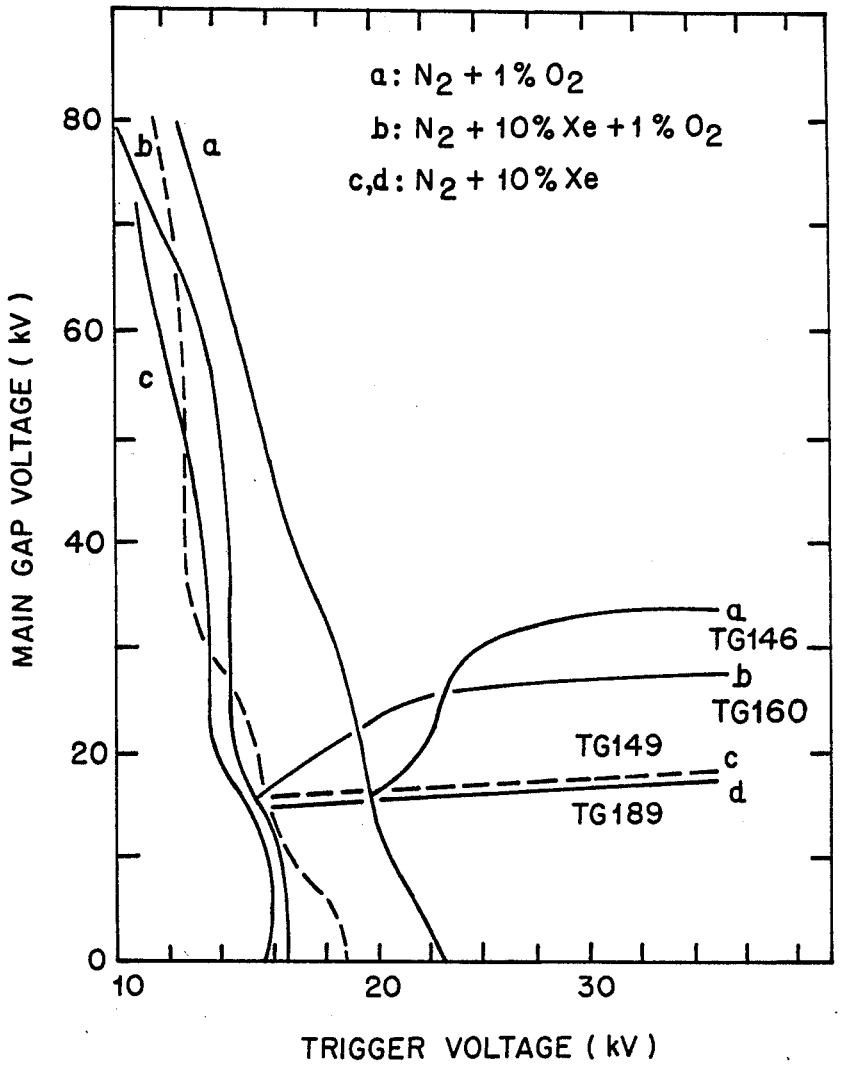
FIG. 4 is a chart depicting several triggering maps for several gas mixtures, including two plots from measurements with the gas mixture of the present invention.

FIG. 4 is a chart depicting measurements which resulted in the triggering maps of a triggerable spark gap discharger for a number of gases, including two measurements made for $N_2+10\%$ Xe. This particular gas mixture (90% $N_2+10\%$ Xe) in a triggerable spark gap allows the spark gap to be triggered with a low main-gap voltage over a much wider range of trigger voltages (e.g., 16–30 or more kV), than with nitrogen (e.g., 18–22 kV) or other commonly used gases and mixtures. Note that in FIG. 4, the right-hand boundary between region M and region T is approximately horizontal for $N_2$+10% Xe, while other gases and mixtures characteristically produce a Y shaped triggering map. The gas mixture of the present invention appears to be immune to the adverse effects of high trigger voltages, at least up to 30 kV.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. In a triggerable spark gap discharger containing three electrodes with a spark gap therebetween, said spark gap being filled with a gas mixture which serves as an insulator and allows the triggerable spark gap discharger to be triggered over a range of trigger voltages, the improvement comprising a selection of about 90 percent nitrogen, and about 10 percent xenon as the gas mixture to widen the range of trigger voltages of the triggerable spark gap discharger.

2. A triggerable spark gap discharger, as defined in claim 1, wherein the range of trigger voltages comprises about 16–30 kV with the selection of 90 percent nitrogen and 10 percent xenon as the gas mixture.

* * * * *